US006378412B1

(12) United States Patent
Wittich et al.

(10) Patent No.: US 6,378,412 B1
(45) Date of Patent: Apr. 30, 2002

(54) LIFTING CYLINDER UNIT FOR A LIFTING PLATFORM

(76) Inventors: Kurt Wittich, Schillerstr. 1; Karl Stach, Brühl 28, both of D-37269 Eschwege (DE)

( * ) Notice: Subject to any disclaimer, the term of this patent is extended or adjusted under 35 U.S.C. 154(b) by 0 days.

(21) Appl. No.: 09/689,044

(22) Filed: Oct. 12, 2000

(30) Foreign Application Priority Data

Nov. 12, 1999 (DE) ..... 199 54 577

(51) Int. Cl.[7] ..... F15B 11/08; F01B 15/02
(52) U.S. Cl. ..... 91/443; 92/169.1; 92/117 A
(58) Field of Search ..... 91/443, 468, DIG. 2; 92/117 R, 117 A, 168, 169.1, 255

(56) References Cited

U.S. PATENT DOCUMENTS 3,166,991 A * 1/1965 Blenkle ..... 92/109

FOREIGN PATENT DOCUMENTS

EP 0 940 584 A2 9/1999
EP 0 957 271 A2 11/1999

* cited by examiner

*Primary Examiner*—Edward K. Look
*Assistant Examiner*—Michael Leslie
(74) *Attorney, Agent, or Firm*—Thomas, Kayden, Horstemeyer & Risley, LLP

(57) ABSTRACT

A lifting cylinder unit (1) has a plunger design, and includes a stationary rod tube (2) having a longitudinal axis (3), two axial end regions, and an outer surface (26). A rod head (4) is arranged in one of the axial end regions of the rod tube (2), the rod head (4) being fixedly connected to the rod tube (2) and including a connecting bore (7). A cylinder tube (14) having two axial end regions and an outer surface (22) is arranged outside the rod tube (2). The cylinder tube (14) is designed and arranged to be movable with respect to the rod tube (2) in the direction of the longitudinal axis (3) of the rod tube (2). A cylinder bottom (15) is arranged in one of the axial end regions of the cylinder tube (14), and is fixedly connected to the cylinder tube (14). A guide bush (18) having an inner surface (23) and including a surface (30) for the application of a force is fixedly connected to the outer surface (26) of the cylinder tube (2). A pressure chamber (31) is arranged inside the rod tube (2), and is designed and arranged to be supplied with a hydraulic medium via the connecting bore (7). A dynamic seal (24) is arranged in the region of the inner surface (23) of the guide bush (18), and is designed and arranged to seal the pressure chamber (31). A running surface (25) is arranged in the region of the outer surface (23) of the rod tube (2), and is designed and arranged to contact the dynamic seal (24).

17 Claims, 5 Drawing Sheets

LIFTING CYLINDER UNIT FOR A LIFTING PLATFORM

CROSS REFERENCE TO RELATED APPLICATIONS

This application claims the benefit of co-pending German Patent Application No. 199 54 577.4-22 entitled "Liftzylindereinheit für eine Hebebühne", filed on Nov. 12, 1999.

FIELD OF THE INVENTION

The present invention generally relates to a lifting cylinder unit for a lifting platform. Such a lifting cylinder unit—together with other structurally identical lifting cylinder units—allows for a lifting platform being lifted and lowered. The lifting platform includes carriers with which the lifting cylinder unit is connected such that the carriers are lifted when the lifting cylinder unit extends, and such that the carriers are lowered when the lifting cylinder unit moves in the opposite direction.

More particularly, the present invention relates to a lifting cylinder unit as it is used in lifting platforms for automobiles in garages.

BACKGROUND OF THE INVENTION

Lifting cylinder units having a piston design are known in the art.

A known lifting cylinder unit includes a stationary rod tube having a longitudinal axis. The rod tube in one of its axial end regions is fixedly and sealingly connected to a rod head. A connecting bore is arranged in the rod head. The lifting cylinder unit is supplied with oil via the connecting bore. A cylinder tube is arranged outside the rod tube to be movable with respect to the rod tube in the direction of the longitudinal axis. The cylinder tube in one of its axial end regions is fixedly and sealingly connected to a cylinder bottom. The rod tube in its axial end facing away from the rod head is fixedly and sealingly connected to a piston. The piston includes a centrally located bore allowing for the passage of the hydraulic medium. A dynamic seal and at least one guide element are arranged at the circumference of the piston, and they contact the inner surface of the cylinder tube. The outer diameter of the piston is slightly less than the inner diameter of the cylinder tube at which the running surface for the dynamic seal is located. The cylinder tube at its axial end facing away from the cylinder bottom is fixedly connected to a guide bush. The guide bush with its inner surface is located on the outer surface of the rod tube. Finally, a supporting ring is welded to the outer surface of the cylinder tube. The supporting ring includes a surface for the application of a force to engage the carriers of the lifting platform.

To lift the lifting platform with the known lifting cylinder unit, a pump pumps oil through the connecting bore into the interior of a pressure chamber being formed by the rod tube. The oil fills the pressure chamber, and it flows through the centrically located bore of the piston in the direction towards the cylinder bottom. While the rod head, the rod tube and the piston are stationary, the cylinder bottom, the cylinder tube, the guide bush and the supporting ring are fixedly interconnected, and they are commonly movable in the direction of the longitudinal axis. When the oil pressure prevailing in the pressure chamber increases, the cylinder bottom moves away from the steady piston. The pressure chamber is sealed by the dynamic seal being located at the piston. To attain a sufficient sealing effect between the dynamic seal and the running surface or the bearing surface, the inner surface of the cylinder tube has an improved surface quality being produced by a special process. For example, the inner surface of the cylinder tube is being peeled and rumbled. Consequently, the process of producing the inner surface of the cylinder tube is rather complex.

When the known lifting cylinder unit is actuated, the guide bush with its inner surface slides over the outer surface of the rod tube. Thus, it is necessary to realize a certain surface quality of the outer surface of the rod tube within defined limits.

In the known lifting cylinder unit, no oil is located in the radial region between the inner surface of the cylinder tube and the outer surface of the rod tube and in the axial region between the piston and the guide bush. This region is connected to the atmosphere by an aerating opening extending through the cylinder tube in a radial direction. Due to the fact that certain humidity is contained in the environmental air, the inner surface of the cylinder tube and the outer surface of the rod tube have to be produced with a special process to prevent corrosion. To prevent corrosion, the inner surface of the cylinder tube and the outer surface of the rod tube include chromium plating. Due to the comparatively small outer diameter of the rod tube, the known lifting cylinder unit has little stiffness with the potential danger of folding.

SUMMARY OF THE INVENTION

Briefly described, the present invention provides a lifting cylinder unit for a lifting platform. The lifting cylinder unit has a plunger design, and it includes a stationary rod tube having a longitudinal axis, two axial end regions and an outer surface. A rod head is arranged in one of the axial end regions of the rod tube, the rod head being fixedly connected to the rod tube and including a connecting bore. A cylinder tube having two axial end regions and an outer surface is arranged outside the rod tube. The cylinder tube is designed and arranged to be movable with respect to the rod tube in the direction of the longitudinal axis of the rod tube. A cylinder bottom is arranged in one of the axial end regions of the cylinder tube, and it is fixedly connected to the cylinder tube. A guide bush having an inner surface and including a surface for the application of a force is fixedly connected to the outer surface of the cylinder tube. A pressure chamber is arranged inside the rod tube, and it is designed and arranged to be supplied with a hydraulic medium via the connecting bore. A dynamic seal is arranged in the region of the inner surface of the guide bush, and it is designed and arranged to seal the pressure chamber. A running surface is arranged in the region of the outer surface of the rod tube, and it is designed and arranged to contact the dynamic seal.

With the novel lifting cylinder unit, the number of necessary structural elements are advantageously reduced. The novel lifting cylinder unit has a simple structural design at low producing costs. The novel lifting cylinder unit has a plunger design. A plunger design means that no piston is being used. Contrary to a plunger design, in piston design, a stationary or movable piston is being used, the piston on its outer diameter carrying a dynamic seal sealingly contacting a running surface being arranged on an inner diameter. In a plunger design, the dynamic seal is arranged on an inner diameter, while the running surface is arranged on an outer diameter having improved surface quality. A dynamic seal is to be understood as a seal having a dynamic side, a relative movement taking place between the dynamic side and an associated running surface. Preferably, the relative movement is a translational movement of either the dynamic seal moving with respect to the running surface or the running surface moving with respect to the dynamic seal. A dynamic seal also has a static side at which no relative movement takes place. In the plunger design, the static side of the dynamic seal is arranged at an inner diameter to be stationary, whereas the dynamic side of the dynamic seal dynamically and sealingly contacts a running surface being located on an outer diameter having improved surface quality.

With the novel lifting cylinder unit, the guide bush is designed and arranged to transmit forces onto the carriers of the lifting platform as well as to seal of the pressure chamber. The dynamic seal is integrated into the guide bush in a way that the running surface for the dynamic seal is formed by the outer surface of the rod tube.

The outer surface of the rod tube contacts the hydraulic medium, preferably oil, up to the dynamic seal. Consequently, there is no danger of corrosion in this region being covered by the hydraulic medium. The inner surface of the cylinder tube does not require a special surface quality or special treatment since this region is not contacted by a dynamic seal. The inner surface of the cylinder tube is always covered with hydraulic medium. For this reason, no special treatment or processing and no improved surface quality is necessary, and there is no danger of corrosion.

In the novel lifting cylinder unit, the number of components requiring an improved surface quality is reduced. The rod tube is the only component requiring a ground surface. Even in the case of this one ground surface, it is advantageous that the surface to be ground is not an inner surface, but instead the outer surface of the rod tube. The treatment of a surface of an inner diameter is always more complex and more expensive than the treatment of the surface of an outer diameter.

Due to the increased outer diameter of the rod tube, the novel lifting cylinder unit has an improved stiffness minimizing the danger of folding.

The guide bush may have a first inner diameter being less than the outer diameter of the cylinder tube. Additionally, the guide bush may have a second inner diameter corresponding to the outer diameter of the cylinder tube. The guide bush carries the dynamic seal being located in the region of the first inner diameter of the guide bush in a way that the dynamic seal together with the outer surface of the rod tube seals the pressure chamber to be pressure-tight. With this arrangement, it is ensured that no hydraulic medium flows through this sealing portion. The guide bush in the region of its second inner diameter is fixedly and sealingly connected to the outer surface of the cylinder tube. For this purpose, the guide bush in the region of its second inner diameter may include an inner thread, and the cylinder tube in the portion of its outer surface contacting the guide bush may include an outer thread. A static seal is arranged in this place to prevent the hydraulic medium from exiting the lifting cylinder unit towards the environment through the connecting portion being formed between the guide bush and the cylinder tube.

Outside the pressure chamber, in an axially outward portion at the end of the guide bush facing away from the cylinder tube, a dust seal including a wiper ring may be arranged in the region of the inner surface of the guide bush adjacent to the to dynamic seal. The dust seal does not fulfill the function of sealing the pressure chamber against the exit of oil, but instead exclusively the function of sealing against the penetration of dirt and dust coming from the environment into the region of the dynamic seal. Thus, the dust seal ensures the correct function of the dynamic seal.

The surface for the application of a force of the guide bush could also be called a support surface. A shoulder of the guide bush may form it. Preferably, the shoulder is formed by the front surface of the guide bush facing the cylinder bottom. The shoulder of the guide bush contacts the carriers of the lifting platform, and it serves to transmit the lifting motion and the lowering motion, respectively, of the cylinder unit onto the lifting platform.

The guide bush may include a first guide element. For this purpose, it is possible to design the guide bush as a cast component. Thus, the inner surface of the guide bush contacts the outer surface and the outer circumference, respectively, of the rod tube to guide the cylinder tube and the guide bush being fixedly connected thereto. Due to the relatively great amount of graphite in the cast material of the guide bush, a tribological system is attained between the inner surface of the guide bush and the outer surface of the rod tube. Consequently, no scuffing occurs. It is also possible that another guide element, for example a guide strip, is arranged in the region of the inner surface of the guide bush. For example, the guide strip may be made of plastic material, and it serves to guide the guide bush and the cylinder tube in a radial direction during their translational movement with respect to the stationary rod tube along the longitudinal axis.

A second guide element may be arranged at the outer surface of the rod tube. The second guide element may also be a guide strip. The guide element is designed to be pervious in a way that the hydraulic medium is not substantially hindered from flowing through and across, respectively, the guide element. Preferably, the second guide element is arranged in the axial end portion of the rod tube facing away from the rod head. With this arrangement, the maximum possible distance between the locations of support being formed by the two guide elements is realized. The stability of the lifting cylinder unit is improved. Even when the lifting cylinder unit is extended to its maximum, the guide bush and the cylinder tube are supported by both guide elements.

A stop element may be arranged at the outer surface of the rod tube in the axial end region of the rod tube facing away from the rod head, the stop element being designed and arranged to limit the stroke of the cylinder tube. With this arrangement, the lifting cylinder unit is prevented from being further extended beyond its maximum desired position. For example, the stop element may be designed as a ring engaging a channel being located in the region of the outer surface of the rod tube. In the maximum extended position of the lifting cylinder unit, the ring contacts a shoulder of the guide bush in a way to prevent further translational movement of the guide bush in this direction.

The guide bush being designed as a cast component may include two front surfaces and a plurality of assembly openings being made by casting and being located at one of the front surfaces, the assembly openings being designed and arranged to be engaged by an assembly tool. The guide bush includes an inner thread corresponding to the outer thread of the cylinder tube. With the assembly openings and an assembly tool engaging the assembly openings, the guide bush may be screwed onto the outer surface of the cylinder tube.

The connecting bore and a check valve may be arranged in the region of the rod head. Depending on the sense of rotation of a pump conveying the hydraulic medium, the hydraulic medium, preferably oil, enters or exits the lifting cylinder unit via the connecting bore, a conduit being connected to the connecting bore and the pump. The pump provides for the necessary pressure difference to actuate the lifting cylinder unit. The check valve ensures that the maximum wanted lowering speed of the lifting cylinder unit is not exceeded to prevent uncontrolled lowering of the lifting cylinder unit possibly endangering the operator of the lifting cylinder unit.

Instead of the check valve, a control valve may be arranged in the region of the rod head. The control valve may be a mechanical 2/2-ways control valve. The 2/2-ways control valve has a passage position and a throttling position. Instead, a 2/3-ways proportional valve having two connections and three positions may be arranged in the region of the rod head. The 2/3-ways proportional valve has a passage position, a throttling position and a locking position.

Other features and advantages of the present invention will become apparent to one with skill in the art upon examination of the following drawings and the detailed description. It is intended that all such additional features and advantages be included herein within the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
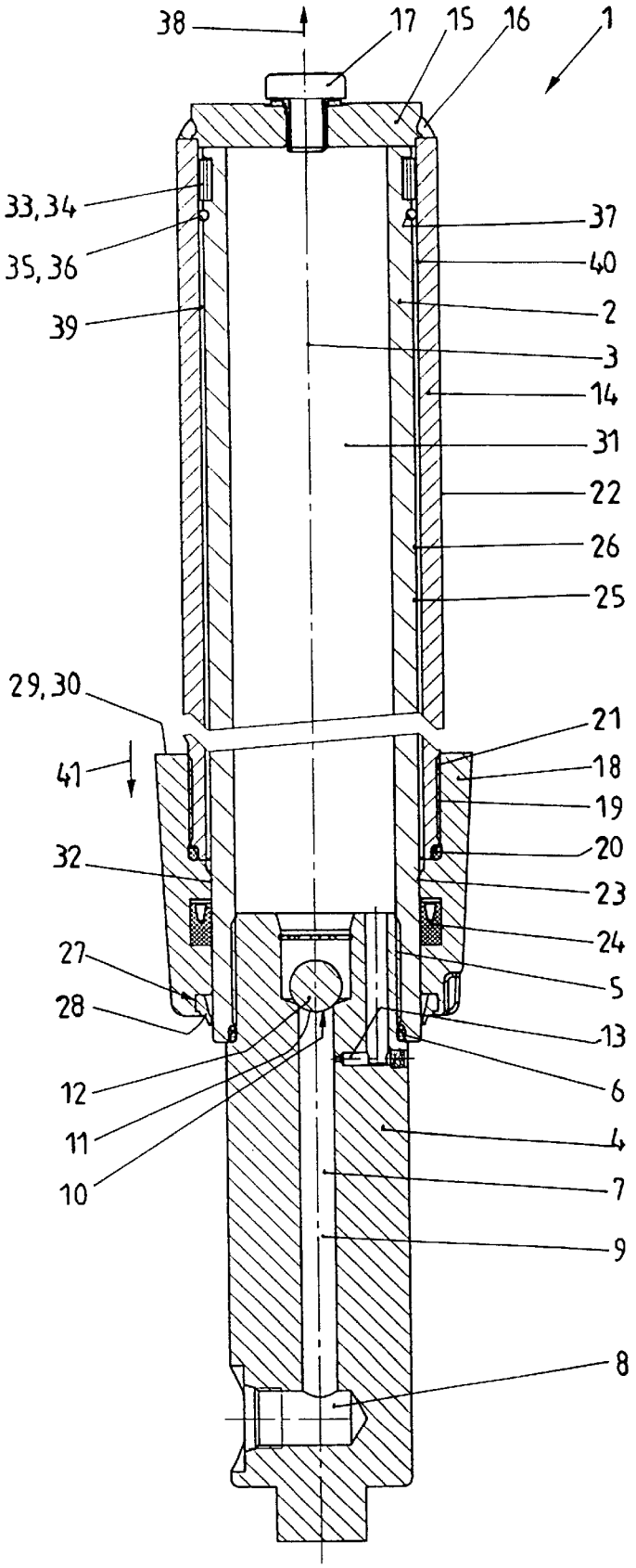
FIG. 1 is a view of a first embodiment of a lifting cylinder unit.

Referring now in greater detail to the drawings, FIG. 1 illustrates a sectional view of a lifting cylinder unit 1 for a lifting platform. The lifting cylinder unit 1 includes a stationary rod tube 2 having a longitudinal axis 3. A rod head 4 is arranged in the lower axial end portion of the rod tube 2. The rod head 4 is fixedly and sealingly connected to the rod tube 2 by a thread 5 and by a seal 6. The rod head 4 includes an outer thread matching an inner thread of the rod tube 2, and it is connected thereto. Furthermore, a connecting bore 7 including a radial pocket bore 8 and an axial through bore 9 being connected thereto is located in the rod head 4. A check valve 10 including a valve seat II and a ball 12 is arranged at the end of the through bore 9 facing away from the pocket bore 8. Additionally, a separate bypass bore 13 is arranged in the rod head 4, the bypass bore 13 connecting the interior of the rod tube 2 with the connecting bore 7 bypassing the check valve 10. The bypass bore 13 includes an axial portion and a radial portion. A cylinder tube 14 is arranged outside of the stationary rod tube 2. The cylinder tube 14 is designed and arranged to be movable with respect to the rod tube 2 in the direction of the longitudinal axis 3. The cylinder tube 14 in its upper axial end portion is fixedly and sealingly connected to a cylinder bottom 15 by a welding 16. An aerating screw 17 is sealingly screwed into the center of the cylinder bottom 15. A guiding bush 18 with its inner surface 21 is fixedly and sealingly connected to the outer surface 22 of the cylinder tube 14 by a thread 19 and a seal 20. The guide bush 18 includes another inner surface 23 the diameter of which is less than the outer diameter of the cylinder tube 14. The diameter of the inner surface 23 of the guide bush 18 is slightly more than the outer diameter of the rod tube 2. The guide bush 18 includes a dynamic seal 24 sealingly contacting a ground running surface 25 being located at the outer surface 26 of the rod tube 2. The ground running surface 25 has been improved surface quality in the range of approximately $R_A$=0.05 to 0.3 micrometers and of approximately $R_{max}$=2.5 micrometers. A dust seal 27 in the form of a wiper ring 28 is arranged in the region of the inner surface 23 of the guide bush 18 adjacent to the dynamic seal 24. The guide bush 18 in its upper axial end portion includes a shoulder 29 forming a surface 30 for the application of a force for the carriers of the lifting platform (not illustrated). The pressure chamber 31 being located in the interior of the rod tube 2 is closed by the dynamic seal 24 and the running surface 25 to be pressure-tight. During operation of the lifting cylinder unit 1, hydraulic medium, preferably oil, is located inside of the pressure chamber 31. The guide bush 18 further includes a first guide element 32. The guide element 32 serves to radially guide the guide bush 18 with respect to the cylinder tube 14. In the illustrated embodiment, the guide bush 18 is designed as a cast part, and it also serves as guide element 32. In this case, the graphite being part of the cast material of the guide bush 18 prevents scuffing in case of a relative movement of the guide bush 18. A second guide element 33 is arranged at the outer surface 26 in the upper axial end portion of the rod tube 2. The second guide element 33 is designed as a plastic guide strip 34. Adjacent to the guide strip 34 and towards the direction of the rod head 4, a stop element 35 for limiting the stroke of the cylinder tube 14 is arranged. The stop element 35 is a ring 36 engaging a continuous channel 37 being located in the outer surface 26 of the rod tube 2.

For the operation of the lifting cylinder unit 1, the connecting bore 7 is supplied with hydraulic medium via a conduit and a pump (not illustrated). During operation, the hydraulic medium enters the pressure chamber 31 through the pocket bore 8, the through bore 9 and the check valve 10, the ball 12 being lifted off the valve seat 11. The pressure chamber 31 is being completely filled with hydraulic medium until the pressure difference between the pressure prevailing in the pressure chamber 31 and the surrounding pressure prevailing outside of the lifting cylinder unit 1 is sufficient to move the cylinder bottom 15, the cylinder tube 14 and the guide bush 18 upwardly in the direction of arrow 38. The hydraulic medium enters a gap 39 being formed between the inner surface 40 of the cylinder tube 14 and the outer surface 26 of the rod tube 2. The second guide element 33 is designed to be pervious for hydraulic medium. Consequently, the hydraulic medium may easily fill out the gap 39 to reach the dynamic seal 24. The dynamic seal 24 is sealingly connected to the running surface 25 such that the hydraulic medium is prevented from exiting the pressure chamber 31. According to arrow 38, the surface 30 for the application of a force being located at the guide bush 18 is also moved in an upward direction.

During use of the lifting cylinder unit 1, the surface 30 for the application of a force contacts carriers of a lifting platform (not illustrated) on which the load to be moved is supported. When the desired position of the surface 30 for the application of a force is reached, operation of the pump is stopped, and the conduit being connected to the connecting bore 7 is locked. In this way, the surface 30 for the application of a force remains in its vertical position. To lower the surface 30 for the application of a force in the direction of arrow 41, the conduit being connected to the connecting bore 7 is reopened such that the hydraulic medium may exit the lifting cylinder unit 1. The lowering speed of the lifting cylinder unit 1 is defined by the smallest diameter of the radial portion of the bypass bore 13. The check valve 10 with its ball 12 closes the valve seat 11 and the connecting bore 7 such that the hydraulic medium may exclusively exit the pressure chamber 31 by the bypass bore 13. The diameter of the bypass bore 13 is chosen such that a maximum lowering speed of 20 feet per minute is not exceeded. In this way, undesired uncontrolled fast lowering of the lifting platform is prevented.

Figure 2:
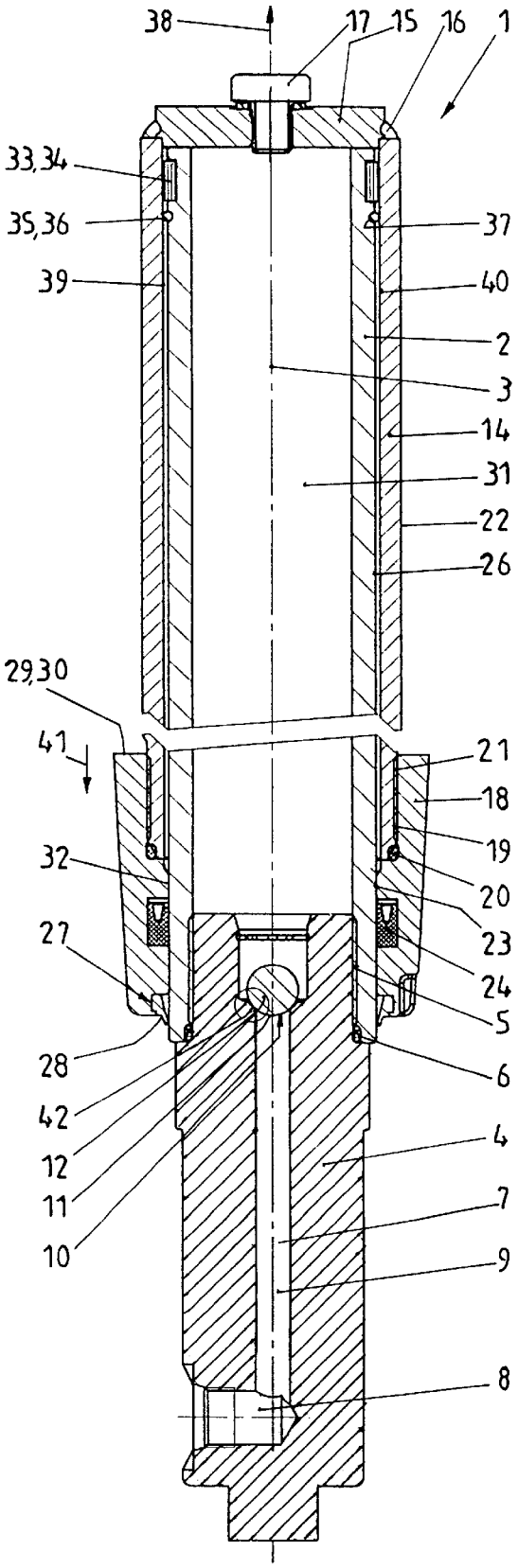
FIG. 2 is a view of a second embodiment of the lifting cylinder unit.

FIG. 2 illustrates a second embodiment of the lifting cylinder unit 1. Most details of the embodiments of FIGS. 1 and 2 are identical. Thus, reference is made to the description of FIG. 1. Contrary to FIG. 1, the lifting cylinder unit 1 as illustrated in FIG. 2 does not include a separate bypass bore 13, but instead a bypass 42 being located at the valve seat 11 of the check valve 10.

Figure 3:
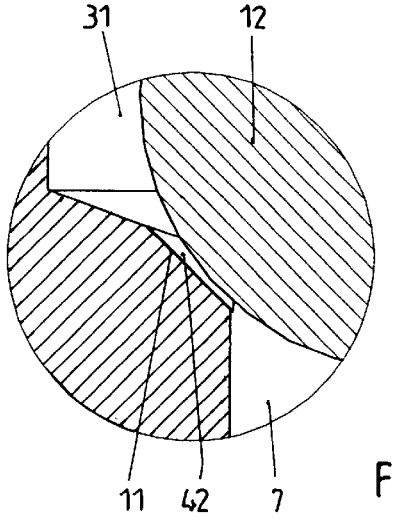
FIG. 3 is a detailed view of the second embodiment of the lifting cylinder unit.

The bypass 42 is to be seen well in FIG. 3. The valve seat of includes a number of channels allowing for the hydraulic medium to flow out of the pressure chamber 31 into the region of the connecting bore 7 even when the ball 12 is located on the valve seat 11. The bypass 42 allows for a controlled lowering of the lifting, platform.

Figure 4:
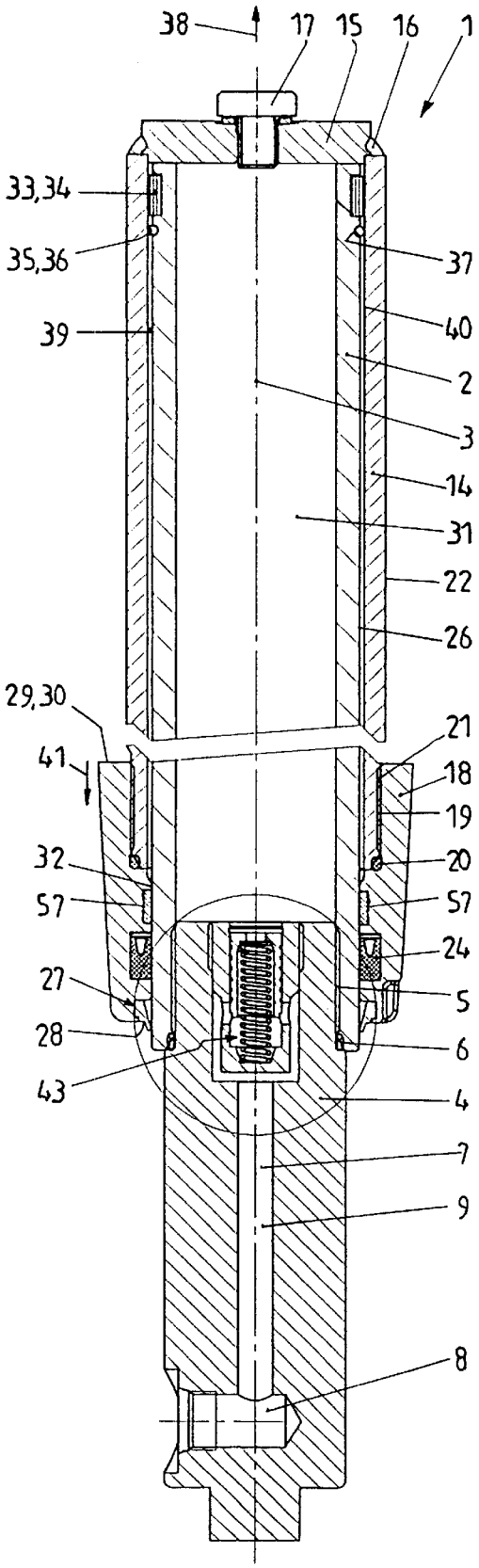
FIG. 4 is a view of a third embodiment of the lifting cylinder unit.
Figure 5:
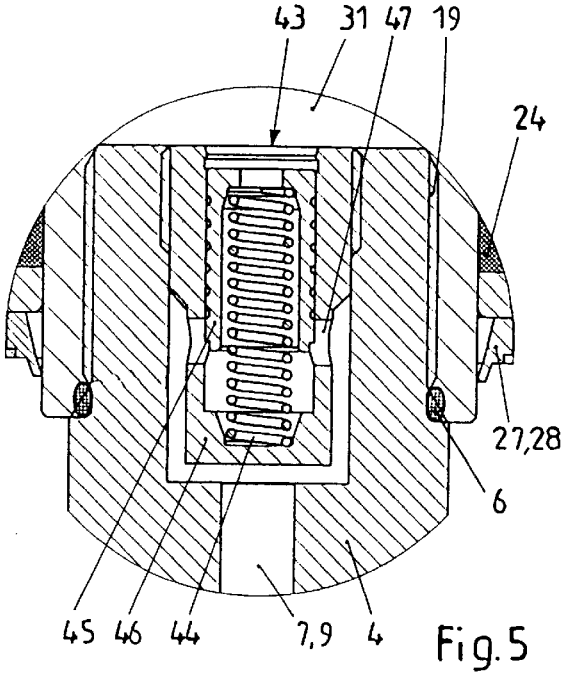
FIG. 5 is a detailed view of the third embodiment of the lifting cylinder unit.

FIGS. 4 and 5 illustrate a third embodiment of the lifting cylinder unit 1. Again, most elements are identical to the embodiments of FIGS. 1 and 2. With respect to these elements, it is referred to the description of FIG. 1. In the third embodiment of the lifting cylinder unit 1 as illustrated in FIGS. 4 and 5, the first guide element 32 is designed as a guide strip 57. Contrary to FIGS. 1 and 2, the lifting cylinder unit 1 includes a 2/2-ways control valve 43 being located in the region of the rod head 4. The 2/2-ways control valve 43 includes a spring 44, a movable valve body 45, a stationary valve body 46 and an opening 47 being located in the stationary valve body 46. The movable valve body 45 includes two switchable positions. In the first position, the opening 47 is not closed by the movable valve body 45 in a way that a throttling position only results from the reduced diameter of the opening 47. Hydraulic medium coming from the pressure chamber 31 may enter the connecting bore 7 with being throttled. In the second position of the 2/2-ways control valve 43, the opening 47 of the stationary valve body 46 is mostly closed by the movable valve body 45 such that the hydraulic medium coming from the pressure chamber 31 may stream into the connecting bore 7 in a strongly throttled matter.

Figure 6:
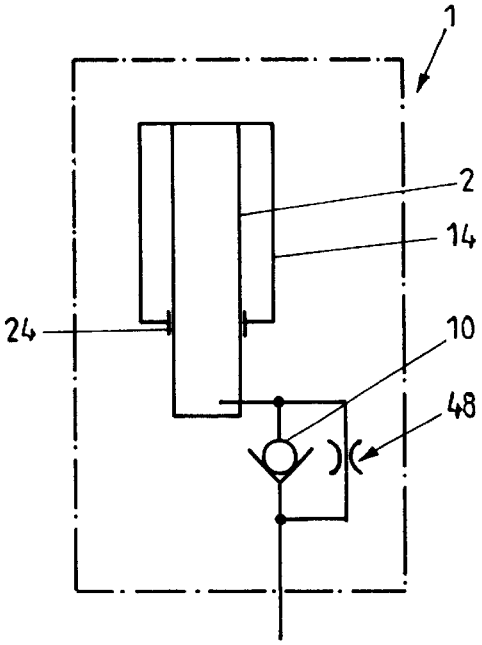
FIG. 6 is a circuit diagram of the lifting cylinder unit including a throttle check valve.

FIG. 6 illustrates a circuit diagram of the lifting cylinder unit 1. The circuit diagram corresponds to the embodiments of the lifting cylinder unit 1 as illustrated in FIGS. 1 to 3. The check valve 10 and the throttle 48 are to be seen from FIG. 6. The throttle 48 corresponds to the bypass bore 13 of FIG. 1 and to the bypass 42 of FIGS. 2 and 3, respectively.

Figure 7:
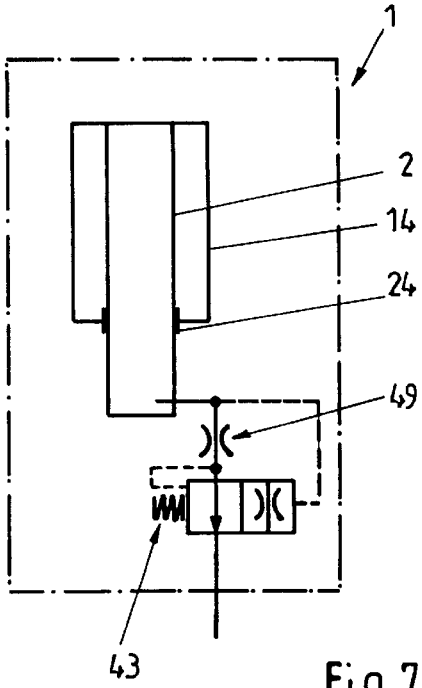
FIG. 7 is a circuit diagram of the lifting cylinder unit including a 2/2-ways control valve.

FIG. 7 illustrates a circuit diagram of the lifting cylinder unit 1 including the 2/2-ways control valve 43. The circuit diagram corresponds to the embodiments of the lifting cylinder unit 1 as illustrated in FIGS. 4 and 5. There is a first throttle 49 being formed by a reduced inlet opening of the 2/2-ways control valve 43. The 2/2-ways control valve 43 further includes a passage position and a throttling position.

Figure 8:
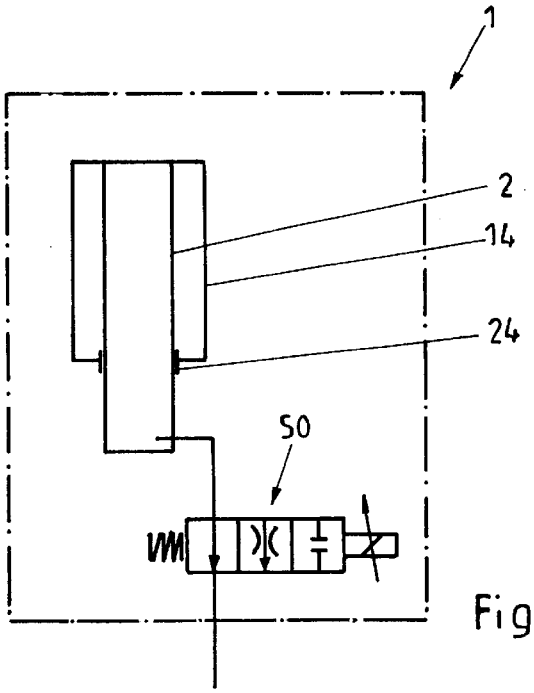
FIG. 8 is a circuit diagram of the lifting cylinder unit including a 2/3-ways proportional valve.

FIG. 8 illustrates another circuit diagram of the lifting cylinder unit 1. The lifting cylinder unit 1 includes an electrically controlled 2/3-ways proportional valve 50 including a passage position, a throttling position and a locking position. The throttling position of the 2/3-ways proportional valve 50 is electrically controllable. In this way, in a circuit including a plurality of lifting cylinder unit 1, the lowering speeds of the lifting cylinder units 1 may be well coordinated.

Figure 9:
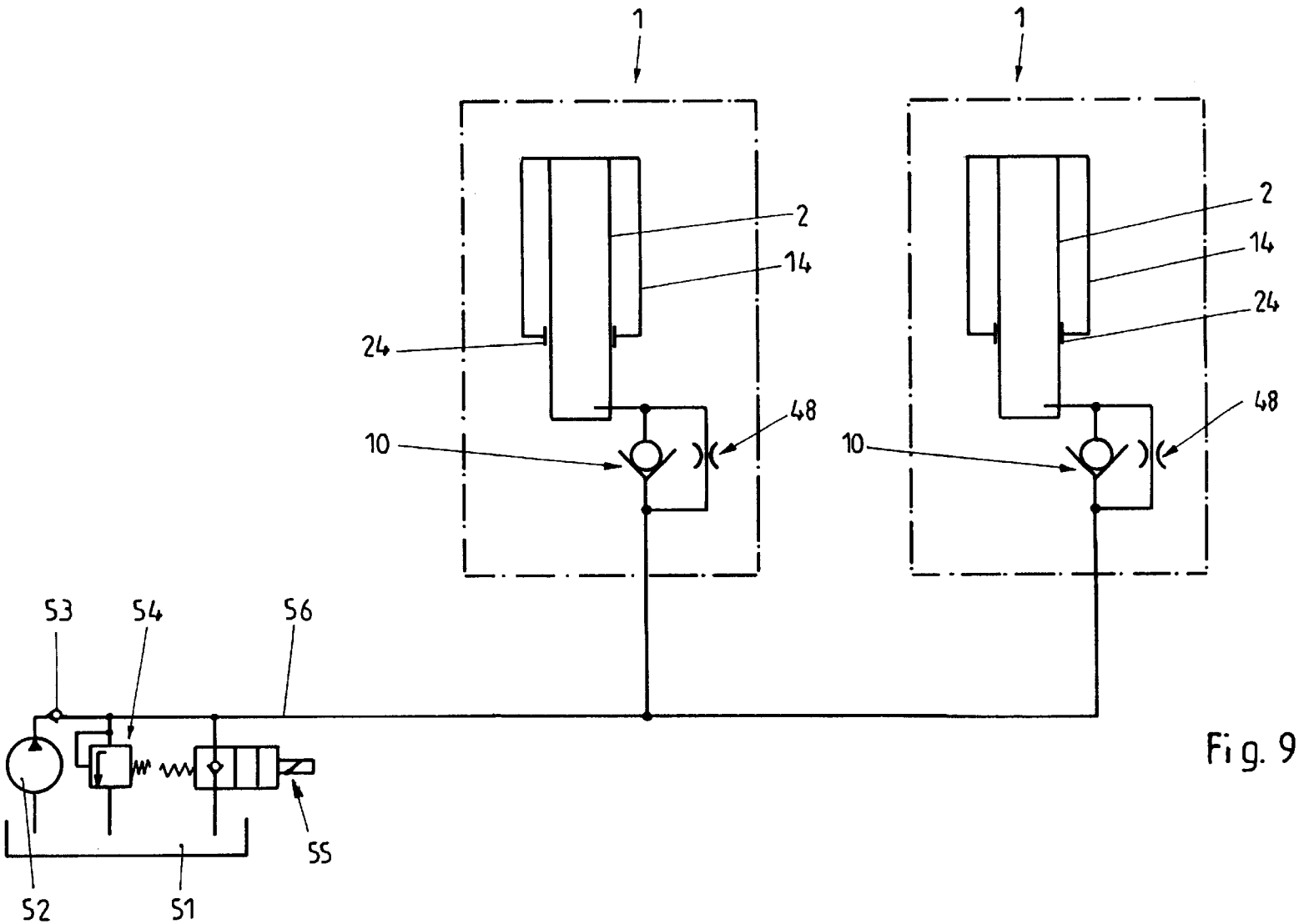
FIG. 9 is a circuit diagram of lifting platform including two lifting cylinder units.

FIG. 9 illustrates a circuit diagram of a lifting platform including two lifting cylinder units 1. The hydraulic medium is fed into the lifting cylinder units 1 from a reservoir 51 and via a check valve 53 by a pump 52. Additionally, there is a safety valve 54 and a 2/2-ways valve 55. The check valve 53 prevents the hydraulic medium from flowing back through the pump 52. The safety valve 54 provides for the hydraulic medium flowing back into the reservoir 51 when the pressure prevailing in the conduit 56 is too much. Consequently, the safety valve 54 prevents the conduit 56 and the lifting cylinder units 1 from being damaged. Due to the arrangement of the safety valve 54, loads being too heavy cannot be lifted. The 2/2-ways valve 55 includes a locking position and a passage position. When the pump 52 is not operated, the locking position of the 2/2-ways valve 55 in connection with the arrangement of the safety valve 54 and the check valve 53 provides for the lifting cylinder units 1 remaining in their position and not being moved back in a downward direction due to the weight of the item to be lifted. To lower the lifting cylinder units 1, the 2/2-ways valve 55 is switched into its passage position. Then, the hydraulic medium coming from the lifting cylinder units 1 may flow back into the reservoir 51 through the conduit 56 in a throttled matter.

Figure 10:
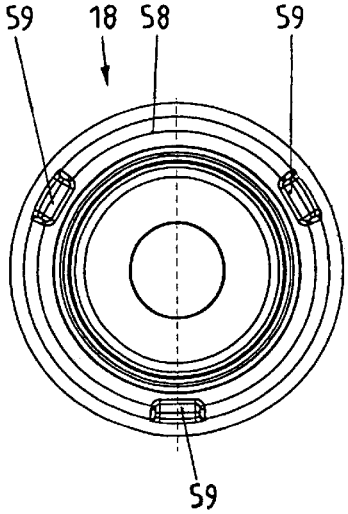
FIG. 10 is a front view of a guiding bush of the lifting cylinder unit.

FIG. 10 illustrates a front view of the guide bush 18 being designed as a cast element. The guide bush 18 includes a plurality of assembly openings 59 being made by casting and being located at its front surface 58, the assembly openings being designed and arranged to be engaged by an assembly tool (not illustrated). The assembly openings 59 serve to screw on and to tighten the guide bush 18 on the thread 19 of the cylinder tube 14 (not illustrated).

Many variations and modifications may be made to the preferred embodiments of the invention without departing substantially from the spirit and principles of the invention. All such modifications and variations are intended to be included herein within the scope of the present invention, as defined by the following claims.

We claim:

1. A lifting cylinder unit for use in a lifting platform, comprising:

a stationary rod tube having a longitudinal axis, two axial end regions, and an outer surface;

a rod head being arranged in one of the axial end regions of said rod tube, said rod head being fixedly connected to said rod tube and including a connecting bore;

a cylinder tube having two axial end regions and an outer surface, said cylinder tube being arranged outside said rod tube, said cylinder tube being designed and arranged to be movable with respect to said rod tube in the direction of the longitudinal axis of said rod tube;

a cylinder bottom being arranged in one of the axial end regions of said cylinder tube and being fixedly connected to said cylinder tube;

a guide bush having an inner surface and including a surface for the application of a force, said guide bush being fixedly connected to the outer surface of said cylinder tube;

a pressure chamber being arranged inside said rod tube and being designed and arranged to be supplied with a hydraulic medium via said connecting bore;

a dynamic seal being arranged in the region of the inner surface of said guide bush and being designed and arranged to seal said pressure chamber; and a running surface being arranged in the region of the outer surface of said rod tube and being designed and arranged to contact said dynamic seal.

2. The lifting cylinder unit of claim 1, wherein said cylinder tube has an outer diameter and said guide bush has a first inner diameter, the first inner diameter of said guide bush being less than the outer diameter of said cylinder tube.

3. The lifting cylinder unit of claim 1, further comprising a dust seal including a wiper ring and being arranged in the region of the inner surface of said guide bush adjacent to said dynamic seal.

4. The lifting cylinder unit of claim 1, wherein said guide bush includes a shoulder, said shoulder forming the surface for the application of a force.

5. The lifting cylinder unit of claim 1, wherein said bush includes a first guide element.

6. The lifting cylinder unit of claim 5, wherein said first guide element is designed as a guide strip.

7. The lifting cylinder unit of claim 5, further comprising a second guide element being arranged at the outer surface of said rod tube.

8. The lifting cylinder unit of claim 7, wherein said second guide element is designed to be pervious for hydraulic medium.

9. The lifting cylinder unit of claim 7, wherein said second guide element is arranged in the axial end region of said rod tube facing away from said rod head.

10. The lifting cylinder unit of claim 1, wherein said guide bush is made by casting.

11. The lifting cylinder unit of claim 10, wherein said guide bush is made by casting and includes two front surfaces and a plurality of assembly openings being made by casting and being located at one of the front surfaces, said assembly openings being designed and arranged to be engaged by an assembly tool.

12. The lifting cylinder unit of claim 1, further comprising a stop element being arranged at the outer surface of said rod tube in the axial end region of said rod tube facing away from said rod head, said stop element being designed and arranged to limit the stroke of said cylinder tube.

13. The lifting cylinder unit of claim 1, further comprising a check valve being arranged in the region of said rod head.

14. The lifting cylinder unit of claim 1, further comprising a control valve being arranged in the region of said rod head.

15. The lifting cylinder unit of claim 14, wherein said control valve is designed as a 2/2-ways control valve.

16. The lifting cylinder unit of claim 14, wherein said control valve is designed as a 2/3-ways proportional valve.

17. The lifting cylinder unit of claim 1, wherein said lifting cylinder unit has a plunger design.

* * * * *